US007389068B2

(12) United States Patent
Ito

(10) Patent No.: US 7,389,068 B2
(45) Date of Patent: Jun. 17, 2008

(54) IMAGE FORMING APPARATUS WITH ADJUSTMENT OF BELT MEMBER

(75) Inventor: Yoshihiro Ito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/756,982

(22) Filed: Jun. 1, 2007

(65) Prior Publication Data

US 2007/0223967 A1 Sep. 27, 2007

Related U.S. Application Data

(62) Division of application No. 10/943,030, filed on Sep. 17, 2004, now Pat. No. 7,239,828.

(30) Foreign Application Priority Data

Sep. 19, 2003 (JP) ..... 2003-329180

(51) Int. Cl.
*G03G 15/00* (2006.01)
*G03G 15/01* (2006.01)
*G03G 15/20* (2006.01)

(52) U.S. Cl. ..... 399/165; 399/162; 399/303; 399/308

(58) Field of Classification Search ..... 242/332.6, 242/352.4, 420.2; 198/329, 810.04; 399/162, 399/165, 302, 308, 303, 313
See application file for complete search history.

(56) References Cited

U.S. PATENT DOCUMENTS 4,397,538 A * 8/1983 Castelli et al. ..... 399/165
4,429,985 A 2/1984 Yokota
4,483,607 A 11/1984 Nagayama
5,017,969 A * 5/1991 Mitomi et al. ..... 399/303 X
5,181,888 A 1/1993 Takahashi et al.
5,246,099 A 9/1993 Genovese
5,410,389 A * 4/1995 Poehlein ..... 399/165
5,717,984 A * 2/1998 Wong ..... 399/165
6,134,406 A * 10/2000 Moe et al. ..... 399/165
6,181,900 B1 * 1/2001 Lee et al. ..... 399/165
6,453,143 B2 * 9/2002 Takeuchi ..... 399/303
6,594,460 B1 * 7/2003 Williams et al. ..... 399/165
7,239,828 B2 * 7/2007 Ito ..... 399/165

FOREIGN PATENT DOCUMENTS

| | | |
|---|---|---|
| DE | 31 38 755 | 5/1982 |
| EP | 0 458 260 | 11/1991 |
| JP | 57-200050 | 12/1982 |
| JP | 60-057043 | 4/1985 |
| JP | 4-60916 | 2/1992 |

(Continued)

*Primary Examiner*—Sandra L Brase
(74) *Attorney, Agent, or Firm*—Fitzpatrick, Cella, Harper & Scinto

(57) ABSTRACT

The image forming apparatus includes a belt member having a convex portion, effecting a circular movement, a first support member and a second support member for supporting the belt member, and a drive receiving unit for receiving force from circular movement of the belt member. An angle of the second support member to the first support member is affected by inputting the force arising from the circular movement into the drive receiving unit, and the force arising from the circular movement is input by contacting convex portion to the drive receiving unit.

3 Claims, 13 Drawing Sheets

FOREIGN PATENT DOCUMENTS

| | | |
|---|---|---|
| JP | 4-121337 | 4/1992 |
| JP | 5-14046 | 1/1993 |
| JP | 5-69979 | 3/1993 |
| JP | 05-324074 | 12/1993 |
| JP | 6-9096 | 1/1994 |
| JP | 6-255826 | 9/1994 |
| JP | 10-231041 | 9/1998 |
| JP | 11-106081 | 4/1999 |
| JP | 2000-44083 | 2/2000 |
| JP | 2000-72218 | 3/2000 |
| JP | 2000-75697 | 3/2000 |
| JP | 2000-75698 | 3/2000 |
| JP | 2000-75699 | 3/2000 |
| JP | 2000-75700 | 3/2000 |
| JP | 2000-75708 | 3/2000 |
| JP | 2000-130523 | 5/2000 |
| JP | 2000-199550 | 7/2000 |
| JP | 2000-272772 | 10/2000 |
| JP | 2002-182483 | 6/2002 |
| JP | 2003-246483 | 9/2003 |

* cited by examiner

IMAGE FORMING APPARATUS WITH ADJUSTMENT OF BELT MEMBER

This application is a division of U.S. patent application Ser. No. 10/943,030, filed Sep. 17, 2004, now U.S. Pat. No. 7,239,828.

BACKGROUND OF THE INVENTION

1. Field of the Invention

The present invention relates to an image forming apparatus using electrophotographic technique.

2. Related Background Art

Conventionally, there has been an image forming apparatus in which there has been adopted transferring material conveying means (transferring material conveying belt) for bearing and conveying a belt member for transferring a toner image on an image bearing member onto transferring material in the image forming apparatus, that is, an intermediate transferring member (intermediate transferring belt) for bearing a toner image to be transferred from the image bearing member, or transferring material for transferring the toner image from the image bearing member.

In the image forming apparatus equipped with the belt member, when the belt member is driven, the belt member tends to shift along a direction of an axis of a member to rotate the belt member as a particularity of a belt mechanism. For example, the belt member tends to shift along a lateral direction. Therefore, it is required that these kinds of shifts of the belt member be restrained. In claims and descriptions in this specification, the term "a lateral direction (shift direction)" is hereinafter used as meaning a direction along which a belt member shifts. As a mechanism for correcting the shift of the belt member, there have been conventionally several types of mechanism as shown in i) to iv).

i) A mechanism for regulating the inclination of the belt member in which the belt member has a rib, and the rib portion is caused to enter a groove provided on a supporting member which supports the belt member to thereby regulate a moving range of the rib within the groove.

ii) A mechanism for coffecting the inclination of the belt member by detecting an inclination state of the belt member, transmitting the detection result electrically, and in response to the result, forcefully causing the supporting member which supports the belt member to change its angle through the use of an actuator consisting of a stepping motor and the like.

iii) A mechanism for adjusting an angle of the supporting member which supports the belt member by receiving, when the belt member shifts along a lateral direction (shift direction), a force in the lateral direction.

iv) A mechanism in which a force of movement of the belt member in the direction of rotation is inputted by drive receiving means provided at the end portion of the supporting member, coming in contact with the back surface of the belt member, and the angle of the supporting member is changed by the force of movement of the belt member.

However, the above-described structure of i) to iv) has the following problems.

In the mechanism of i), since the rib is to receive a reaction of the force of inclination of the belt member, a strong force is exerted on the rib when the inclination occurs, and the force is exerted on the belt member to further deterioration of the durability of the belt member.

The mechanism of ii) results in complicated mechanism such as supply of electricity being required around the belt member.

In the mechanism of iii), since an inclination speed of the belt member is generally slow, response of the supporting member to the change in angle is slow.

In the mechanism of iv), the flatness of the belt member may not be secured, or strain may occur.

SUMMARY OF THE INVENTION

In view of the above-describe problems, the present invention has been achieved.

In other words, an object of the present invention is to correct the inclination of the belt member simply and with stability while securing the flatness of the belt member.

Another object of the present invention is to provide an image forming apparatus comprising: a belt member for moving in circulation; a first supporting member for supporting the belt member; a second supporting member for supporting the belt member; and drive receiving means for receiving a force of movement of the belt member in the direction of rotation, wherein the force of movement is inputted into the drive receiving means, whereby an angle of the second supporting member relative to the first supporting member changes, and wherein the belt member has a convex portion, the convex portion and the drive receiving means come into contact with each other, and the force of movement is inputted.

Also, the other object is to provide an image forming apparatus comprising: a belt member for moving in circulation; a first supporting member for supporting the belt member; a second supporting member for supporting the belt member; drive receiving means for receiving a force of movement of the belt member in the direction of rotation; drive conversion means for converting the force of movement to be inputted into the drive receiving means to a force for changing the angle of the second supporting member relative to the first supporting member, wherein the drive conversion means inhibits the force to the second supporting member or the first supporting member from being transmitted to the drive receiving means.

DESCRIPTION OF THE PREFERRED EMBODIMENTS

Hereinafter, with reference to the drawings, the detailed description will be made of the image forming apparatus according to the present invention.

First Embodiment (Overall Structure of Image-Forming Apparatus)

Figure 13:
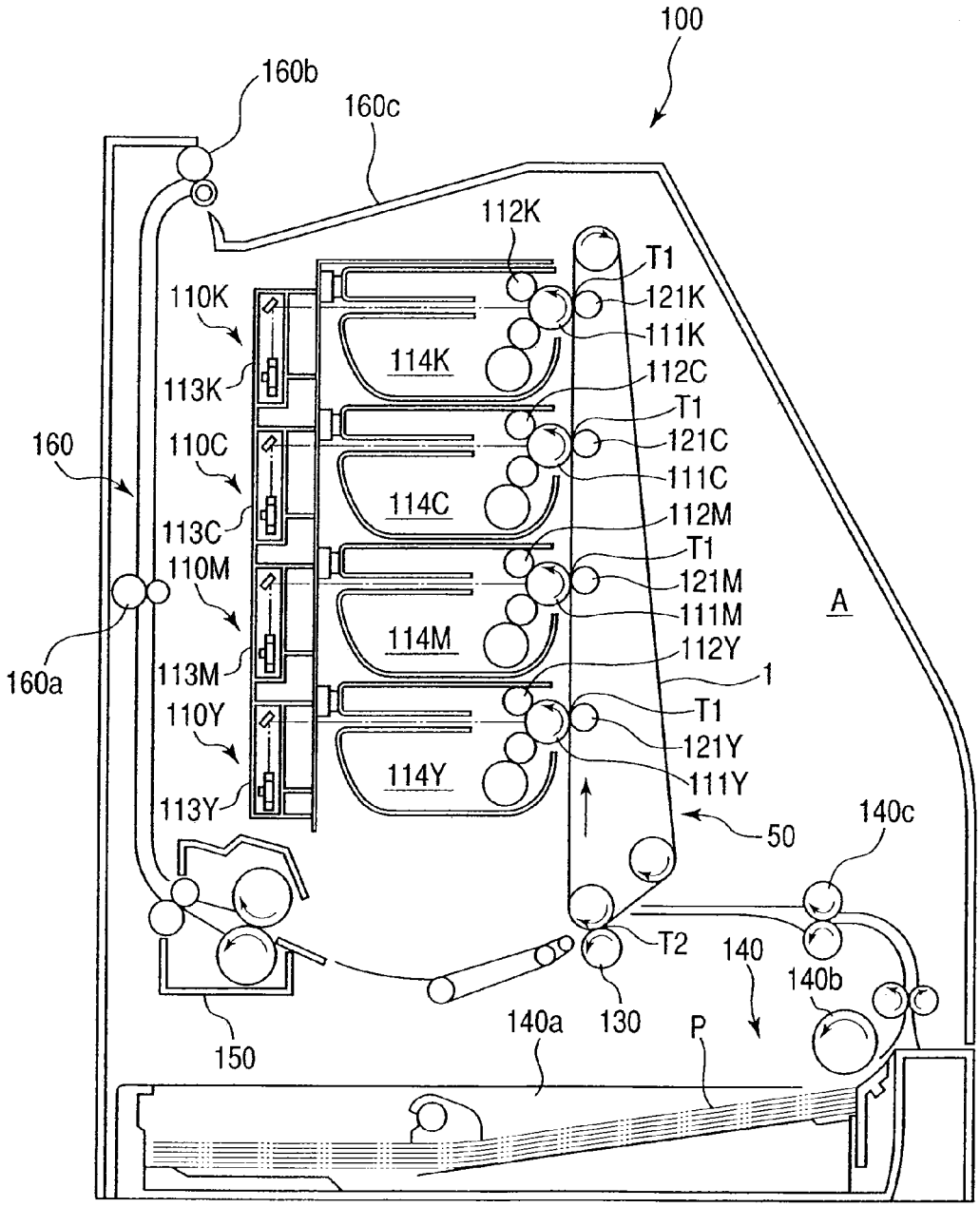
FIG. 13 is a schematic cross-sectional block diagram showing another embodiment of the present invention.

FIG. 13 shows schematic cross-sectional structure of an image forming apparatus according to an embodiment of the present invention. In the present embodiment, the present invention is embodied by a color laser beam printer of the electrophotographic system. However, the present invention is not limited thereto, but is widely applicable to image forming apparatuses using the electrophotographic system.

An image forming apparatus 100 according to the present embodiment is capable of forming a color image on transfeffing material P such as, for example, a recording sheet, an OHP sheet or cloth through the use of the electrophotographic system in accordance with a signal transmitted from external equipment such as a personal computer connected to the main body A of the image forming apparatus 100 so as to be able to communicate.

Within the main body A of the image forming apparatus, a plurality of image forming units 110Y, 110M, 110C and 110K for forming toner images of each color of yellow, magenta, cyan and black respectively have been arranged linearly in a substantially vertical direction in this case as a plurality of image forming means, and an intermediate transferring unit or belt supporting device 50 has been arranged so as to oppose each image forming unit 110Y, 1110M, 110C and 110K. As described later in detail, the intermediate transferring unit or belt supporting device 50 has a belt member (intermediate transferring belt) 1 as an intermediate transferring member (image bearing member) so as to be able to move in circulation in opposition to each image forming unit 110Y, 110M, 110C and 110K. Thus, in the present embodiment, as this belt member 1 moves, toner images formed by each image forming unit 110Y, 110M, 110C, and 110K are transferred onto the belt member 1 in order, and thereafter, are collectively transferred onto transferring material P, whereby a color image obtained by transferring a toner image having a desired number of colors can be formed on the transferring material P.

Since each image forming unit 110Y, 110M, 110C, and 110K performs the same operation with the same structure except that toner images to be formed respectively are different from one another in color, when it is not necessary to particularly distinguish hereinafter, suffixes of Y, M, C and K which have been given to symbols in the figures in order to show that it is an element belonging to any one of each image forming unit 110Y, 110M, 110C and 110K will be omitted to explain collectively.

The image forming unit 110 forms a toner image through the use of a well-known electrophotographic image forming process. In other words, the image forming unit 110 is provided with a cylindrical electrophotographic photosensitive member as an image bearing member, that is, a photosensitive drum 111 so as to be able to rotate in a direction indicated by an arrow in the figure. In an image forming operation, the surface of the photosensitive drum 111 which rotates is first uniformly charged by a charging roller 112, which is charging means. Next, in accordance with a signal transmitted from a computer, a laser of a laser scanner 113 as exposure means emits light to scan and expose the photosensitive drum 111 charged, whereby an electrostatic image is formed on the photosensitive drum 111. To the electrostatic image formed on the photosensitive drum 111, a developer device 114, which is developing means, supplies toner as developer to visualize a toner image. The toner image thus formed on the photosensitive drum 111 is electrostatically transferred onto the belt member 1 by an operation of a primary transferring roller 121, which is primary transferring means, arranged in opposition to the photosensitive drum 111 via the belt member 1 in a primary transferring member T1.

By means of such a process as described above, toner images formed on the photosensitive drums 111 of each image forming unit 110Y, 110M, 110C, and 110K by timing to the movement of the belt member 1 are superimposed and transferred on the belt member 1 in order.

On the other hand, transferring material P sent out from a transferring material housing portion 140*a* by means of a pickup roller 140*b* or the like in a transferring material supply unit 140 is conveyed to an abutted portion (secondary transferring portion) T2 between a secondary transferring roller 130, which is secondary transferring means, and the belt member 1 by timing at a registration roller 140*c*. Thus, the toner image on the belt member 1 is electrostatically transferred onto the transferring material P by the operation of a secondary transferring roller 130 in the secondary transferring portion T2.

Next, the transferring material P is separated from the belt member 1 to be conveyed to a fixing unit 150, where the toner image on the transferring material P is heated under pressure to be firmly fixed on the transferring material P. Thereafter, the transferring material P is conveyed by a conveying roller, 160*a*, 160*b* and the like of a discharge unit 160 to be discharged on a discharge tray 160*c*.

In the image forming apparatus 100 according to the present embodiment, the photosensitive drum 111, the charging roller 112 and the developer device 114 of each image forming unit 110 are convened into a cartridge integrally by a frame member and are made into a process cartridge detachably attachable to the main body A of the image forming apparatus. Also, the belt supporting device 50 is also adapted to be detachably attachable to the main body A of the image forming apparatus.

(Belt supporting device)

Figure 1:
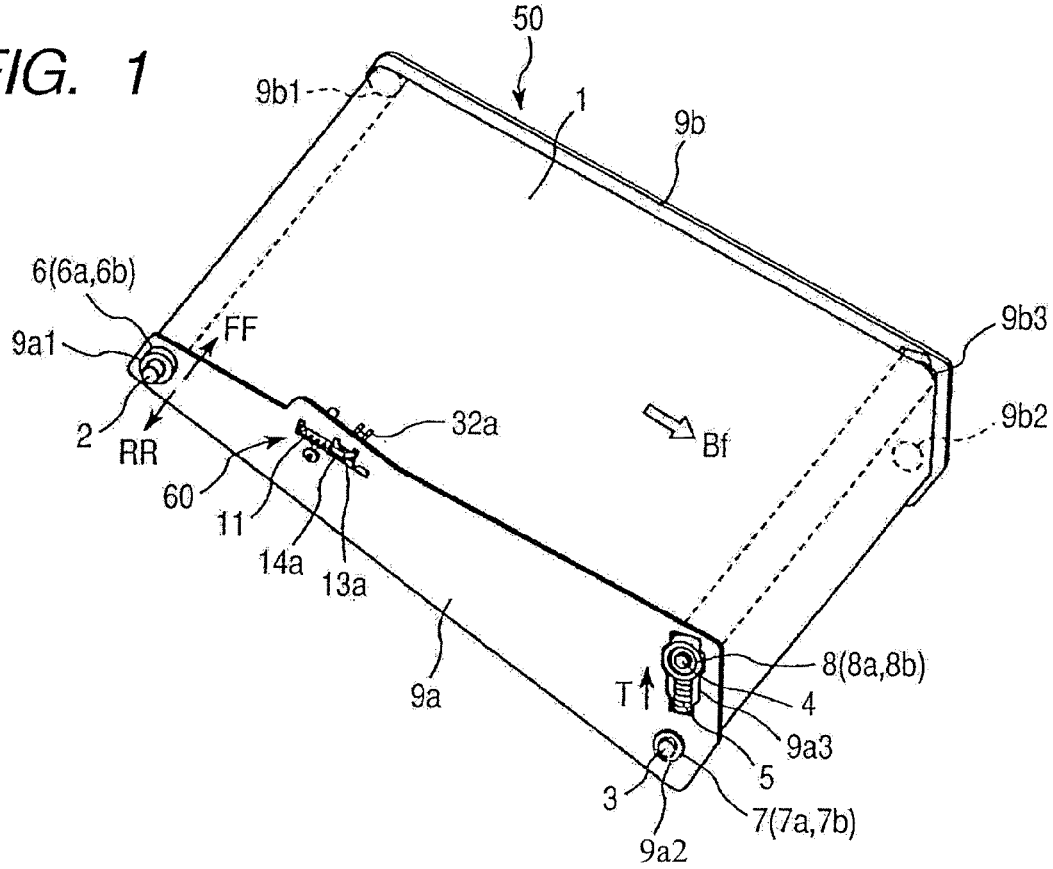
FIG. 1 is a schematic perspective view showing a belt supporting device according to an embodiment of the present invention.

Next, the description will be made of the belt supporting device which is most characteristic in the present embodiment. FIG. 1 shows an outside appearance of the belt supporting device 50 according to the present embodiment.

First, the description will be made of the overall structure of the belt supporting device 50. The belt supporting device 50 is supported by the belt member 1 and three rollers: a drive roller 2 for driving the belt member 1; a driven roller (platen roller) 3 for driven-rotating; and a tension roller 4, as a plurality of supporting members for supporting the belt member 1.

In the drive roller 2, the driven roller 3, and the tension roller 4, both their respective end portions in the longitudinal direction are rotatively supported by bearings 6 (6*a*, 6*b*), 7 (7*a*, 7*b*) and 8 (8*a*, 8*b*), respectively. Thus, first and second side plates 9*a*, 9*b* hold the bearings 6, 7 and 8 for supporting three rollers.

Figure 2:
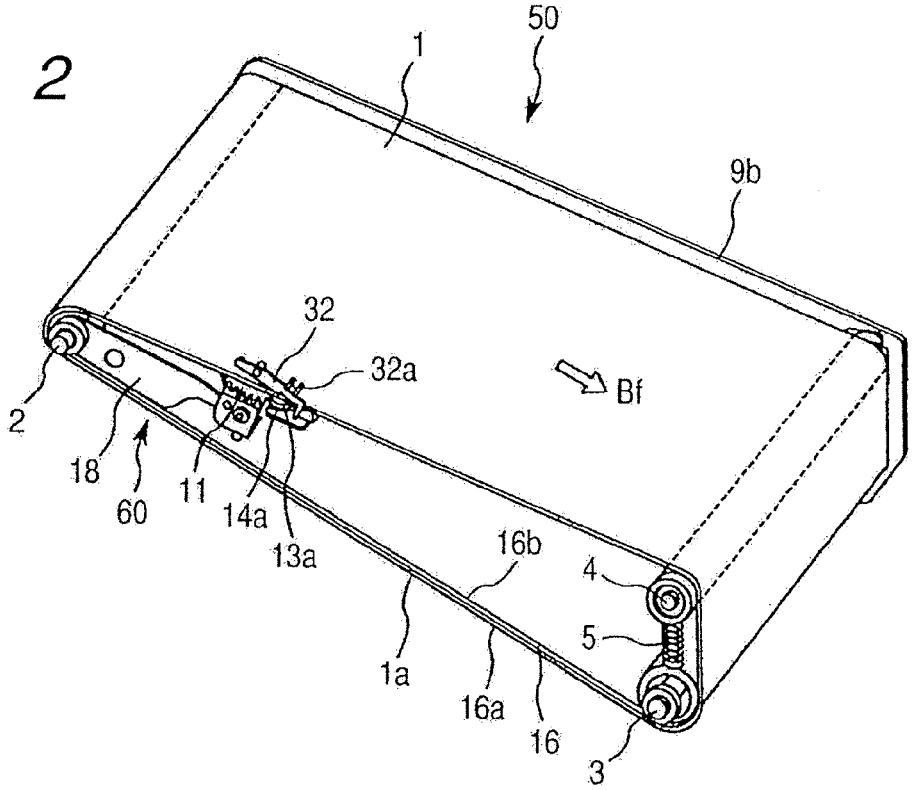
FIG. 2 is a schematic perspective view showing a state in which by removing a side plate from the belt supporting device of FIG. 1, the interior has been arranged so that it can be seen.
Figure 3:
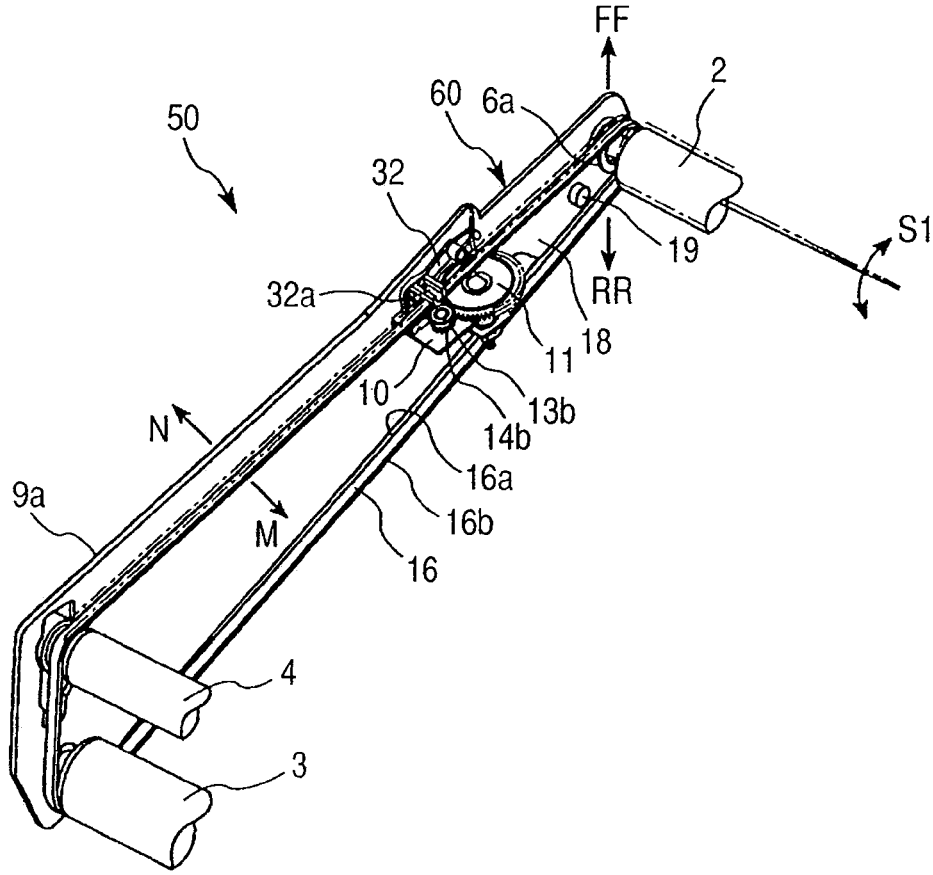
FIG. 3 is a partial cross-sectional perspective view showing the belt supporting apparatus of FIG. 1.

FIG. 2 shows a state in which by removing one side plate (first side plate) 9*a* from the belt supporting device 50, the interior has been arranged so that it can be seen, and FIG. 3 shows a cut model of the belt supporting device 50, showing a look in which parts held by the first side plate 9*a* are seen from the inside of the first side plate 9*a* (of the belt member 1, the belt surface is omitted).

In a state in which the belt supporting device 50 has been housed within the main body A of the image forming apparatus, on this side of space of FIG. 13, there is the first side plate 9a of the belt supporting device 50, and the driven roller 3 abuts against the secondary transferring roller 130 via the belt member 1 within the main body A of the image forming apparatus to form the secondary transferring portion T2.

The drive roller 2 is driven by a power source (not shown) provided in the main body A of the image forming apparatus to rotate. Thereby, the belt member 1 rotationally moves (moves in a cycle) in such a manner that the belt member 1 circulates around the drive roller 2, the driven roller 3 and the tension roller 4 in a direction indicated by an arrow Bf in the figure. In the present embodiment, the bearing 6*a* on the movable side of the drive roller 2, that is, on the first side plate 9*a* side is held by a long and narrow bearing holding hole 9*a*1 provided in the first side plate 9*a* so as to be slidable in a direction indicated by an arrow FF/RR in the figure. On the other hand, the bearing 6*b* of the drive roller 2 on the second side plate 9*b* side is fixed at a bearing holding hole 9*b*1 provided in the second side plate 9*b*. Thereby, the drive roller 2 is adapted to be rockable in a direction indicated by an arrow S1 in FIG. 3 with the bearing 6*b* on the second side plate 9*b* side as a center of rocking.

The bearings 7*a*, 7*b* for axially supporting the driven roller 3 are fixed by bearing holding holes 9*a*2, 9*b*2 provided in the first and second side plates respectively. The driven roller 3 driven-rotates by moving the belt member 1 by the drive roller 2.

Also, the tension roller 4 is movably held in a direction indicated by an arrow T in the figure, that is, in a direction to separate from a plane which is formed by the belt member 1 extended between the drive roller 2 and the driven roller 3. In other words, the bearings 8*a*, 8*b* for axially supporting the tension roller 4 are slidably held by long and narrow bearing holding holes 9*a*3, 9*b*3 provided in the first and second side plates 9*a*, 9*b* respectively, and these bearings 8*a*, 8*b* are biased by a tension roller biasing spring 5, which is an elastic member, as biasing means. This gives a tension to the belt member 1. The tension roller 4 driven-rotates by moving the belt member 1 by the drive roller 2. Also, the tension roller 4 is maintained substantially in parallel with the driven roller 3.

The belt member 1 is, in the present embodiment, an endless belt formed by polyimide, having circumference of 675 mm, width of 258 mm and thickness of 60 μm. The material of the intermediate transferring member is not limited thereto, but in addition to the above-described one, a belt member 1 formed by polycarbonate, PVDF, ETFE, PTFE and the like can be suitably used. The belt member 1 has a rib 16 (rib member), which is a convex portion of the belt member 1, mounted in the neighborhood of one edge portion (first side plate 9*a* side) 1*a* in a substantially orthogonal direction (lateral direction (shift direction) of the belt member 1) to the conveying direction (direction of movement of rotation) Bf on the inner part thereof. In the present embodiment, the rib 16 stands up in a substantially orthogonal direction to the belt surface, extending over the entire circumference of the belt member 1. This is a projection formed by urethane having width of 4 mm and height of 1.5 mm, and is provided 0.5 mm inside from an edge portion 1*a* of the belt member 1 on the first side plate 9*a* side.

Figure 4:
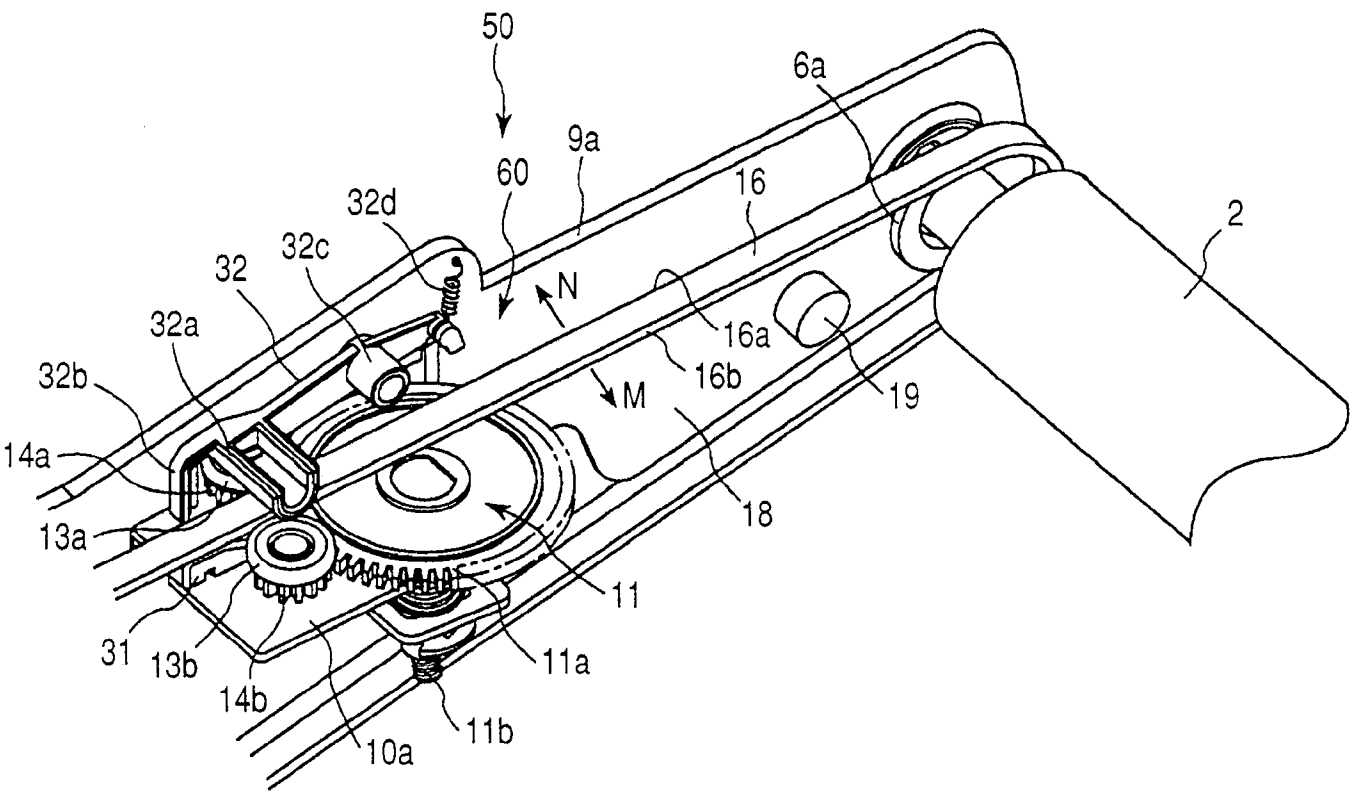
FIG. 4 is an enlarged view showing a center adjusting mechanism which the belt supporting device of FIG. 1 has.
Figure 5:
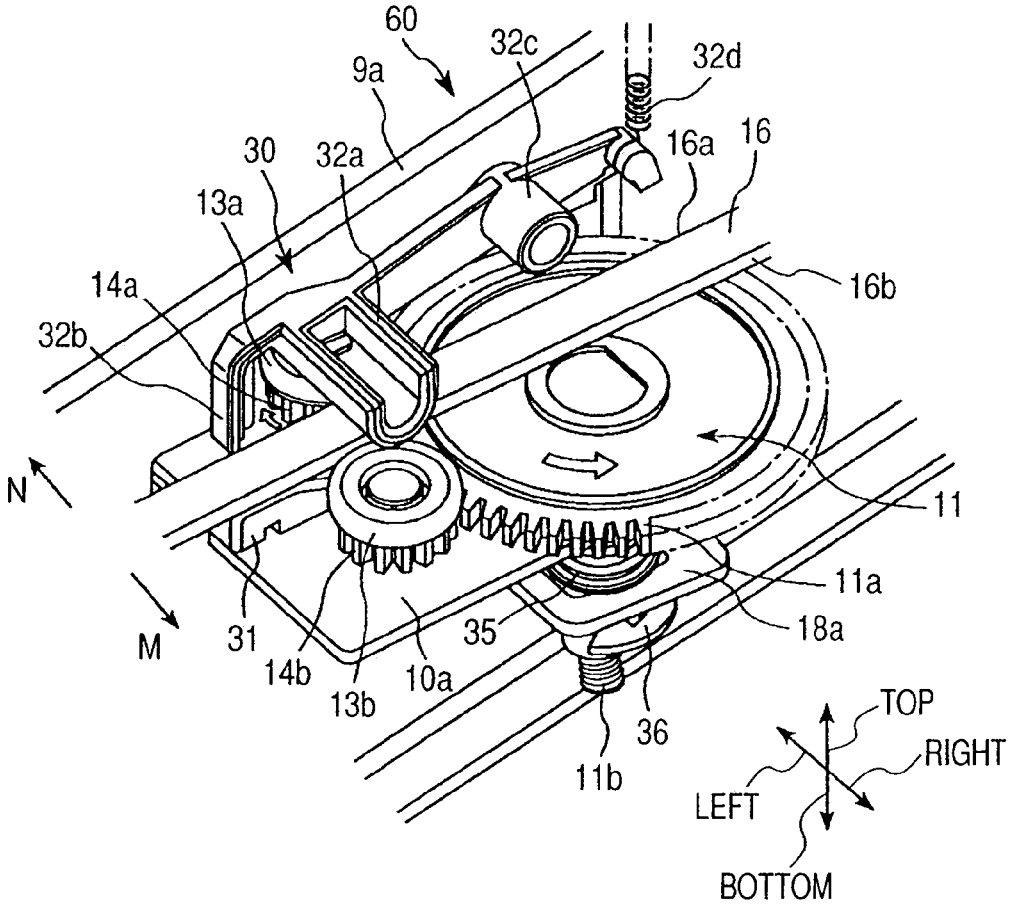
FIG. 5 is an enlarged view showing a center adjusting mechanism which the belt supporting device of FIG. 1 has.
Figure 6:
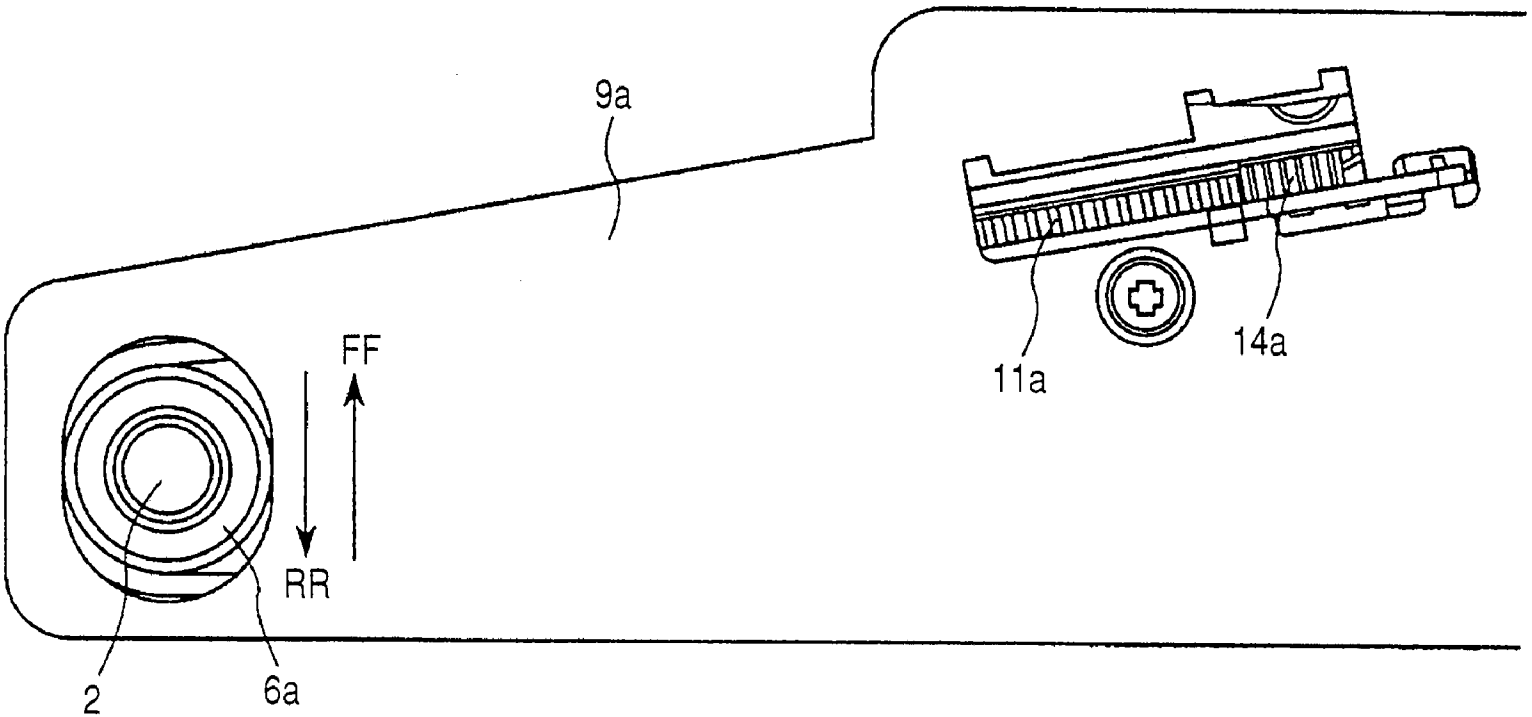
FIG. 6 is a side view showing the look in which the side plate of the belt supporting device of FIG. 1 has been seen from the outside.
Figure 7:
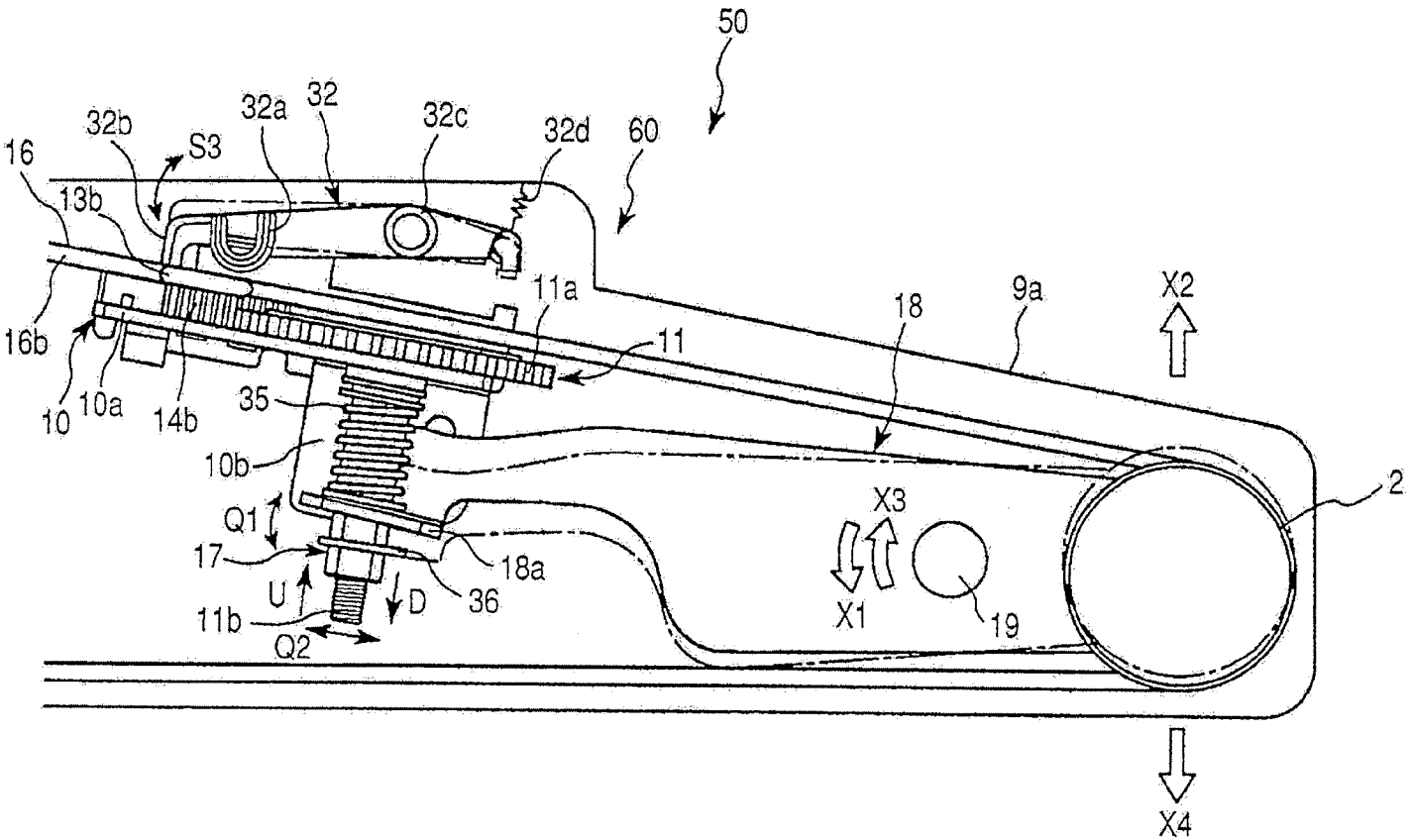
FIG. 7 is a side view showing the look in which the side plate of the belt supporting device of FIG. 1 has been seen from the inside.

Next, with reference to FIGS. 4, 5 and 7, the description will be made of a center adjusting mechanism (center adjusting unit) 60 which the belt supporting device 50 has. As described above, in the belt mechanism, there may occur an inclination of the belt member 1 during driving. In order to prevent the belt member from being damaged among others, and to maintain excellent image quality, it is required to effectively correct this inclination. For this reason, the belt supporting device 50 according to the present embodiment has such a center adjusting unit 60 of the belt member 1 as explained below. FIGS. 4 and 5 show an enlarged center adjusting unit 60 (of the belt member 1, the belt surface is omitted).

In the present embodiment, as described above, the belt supporting device 50 has: the belt member 1 for transferring a toner image on the photosensitive drum 111 onto the transfeffing material P; a first supporting member (driven roller 3 or tension roller 4) for supporting the belt member 1; and a second supporting member (drive roller 2) capable of supporting the belt member 1 and changing an angle with respect to the first supporting member. Thus, the belt supporting device 50 has contact members 13*a*, 13*b* which are drive receiving means constructed such that they can come into contact with the belt member 1 and a contact state with the belt member 1 changes, and in response to a contact state between these contact members 13*a*, 13*b* and the belt member 1, an angle of the second supporting member (drive roller 2) to the first supporting member (driven roller 3 or tension roller 4) is adapted to change. Thereby, the belt member 1 moves in a direction indicated by an N/M in the figure, that is, in a direction substantially orthogonal to the conveying direction Bf of the belt member 1.

In the present embodiment, the contact members 13*a*, 13*b* are constructed so as to be able to receive a driving force of the belt member 1 by coming into contact with the belt member 1 in such a manner that the driving force to be inputted from this belt member 1 changes an angle of the drive roller 2 to the driven roller 3 or the tension roller 4.

Also, depending on a position of the belt member 1 in a direction substantially orthogonal to the conveying direction Bf of the belt member 1, an amount of the driving force of the belt member 1 to be inputted to the contact members 13*a*, 13*b* is caused to differ; depending on a position of the belt member 1 in a direction substantially orthogonal to the conveying direction of the belt member 1, there will be caused to be a case where the driving force is inputted to the first or second contact member 13*a*, 13*b* and a case where no driving force is inputted; and depending on the driving force to be inputted into the first contact member 13*a* or the second contact member 13*b*, the angles of the drive roller 2 to the driven roller 3 and the tension roller 4 will be caused to change in the opposite direction to each other.

In the present embodiment, the center adjusting unit 60 has: freely rotatable first and second rollers 13*a*, 13*b* which are first and second contact members provided so as to be able to come into contact with, in the neighborhood of an end portion in a direction substantially orthogonal to the conveying direction Bf of the belt member 1, in this case, side surfaces 16*a*, 16*b* respectively to which the rib 16, which is the drive input portion provided on the belt member 1, opposes; a gear portion 11*a* of a threaded gear 11 as a freely rotatable rotation member to which turning effects of the first and second rollers 13*a*, 13*b* are transmitted; a threaded portion (spiral boss) 11*b* of the threaded gear 11 as driving means coaxial to the gear portion 11*a*, for rotating integrally; a nut 17, which is a moving element which engages with the threaded portion 11*b* and is driven by rotation of the threaded portion 11*b*; and a lever 18, which is a coupling element for transmitting to a movable portion of a drive roller 2 in which parallelism to the driven roller 3 or the tension roller 4 is held so as to be changeable.

When the belt member 1 moves in a direction substantially orthogonal (direction indicated by an arrow M or N in the figure) to the conveying direction Bf with the above-described structure, the rib 16 provided on the belt member 1 comes into contact with the first or second roller 13*a* or 13*b* to rotate the first or second roller 13*a* or 13*b*. Thus, the turning effect (force by rotation) of the first or second roller 13*a* or 13*b* is transmitted to the gear portion 11*a* of a threaded gear 11, which is the same rotation member, and the gear portion 11*a* and the threaded portion 11*b* rotate, whereby the nut 17 moves in a direction indicated by an arrow U or D in the figure along the longitudinal direction of the threaded portion 11*b*. The movement of this nut 17 is transmitted to the lever 18, and the movable portion of the drive roller 2, that is, the bearing 6*a* on the first side plate 9*a* side is caused to move in a direction indicated by an arrow FF or RR in the figure.

In this case, when the lever 18 moves the movable portion of the drive roller 2 to change the parallelism to the drive roller 2 and the driven roller 3 or the tension roller 4, a direction in which an angle between a center axis (rotary center axis) of the driven roller 3 and a center axis (rotary center axis) of the tension roller 4 changes will be caused to become opposite to a direction in which the belt member 1 moves in a direction substantially orthogonal to the conveying direction Bf. Thereby, the belt member is to be returned in a direction opposite to a direction in which it has moved in the M or N direction.

Hereinafter, with reference to FIGS. 6 to 11, the further detailed description will be made of the belt training mechanism 60 of the belt member 1 according to the present embodiment. In this respect, in the following description, when referring to a direction concerning the center adjusting unit 60, the surface side of the belt member 1 to be supported between the drive roller 2 and the tension roller 4 will be assumed to be "TOP (UP)", the back surface (surface on which the rib 16 has been provided), "BOTTOM (DOWN)", further the first side plate 9a side, "LEFT", and the second side plate 9*b* side, "RIGHT".

The center adjusting unit 60 has a center adjusting unit chassis 10 fixed to the first side plate 9*a*. The center adjusting unit chassis 10 has the main body 10*a* of a chassis substantially parallel with the surface of the belt member 1 supported between the drive roller 2 and the tension roller 4 and a chassis installation area 10*b* for extending in a direction substantially orthogonal to the main body 10*a* of the chassis, and the chassis installation area 10*b* is fixed along the first side plate 9*a* , whereby the center adjusting unit chassis 10 is arranged at a predetermined position. To this center adjusting unit chassis 10, the rollers 13*a*, 13*b*, the threaded gear 11 and the like are installed.

Figure 11:
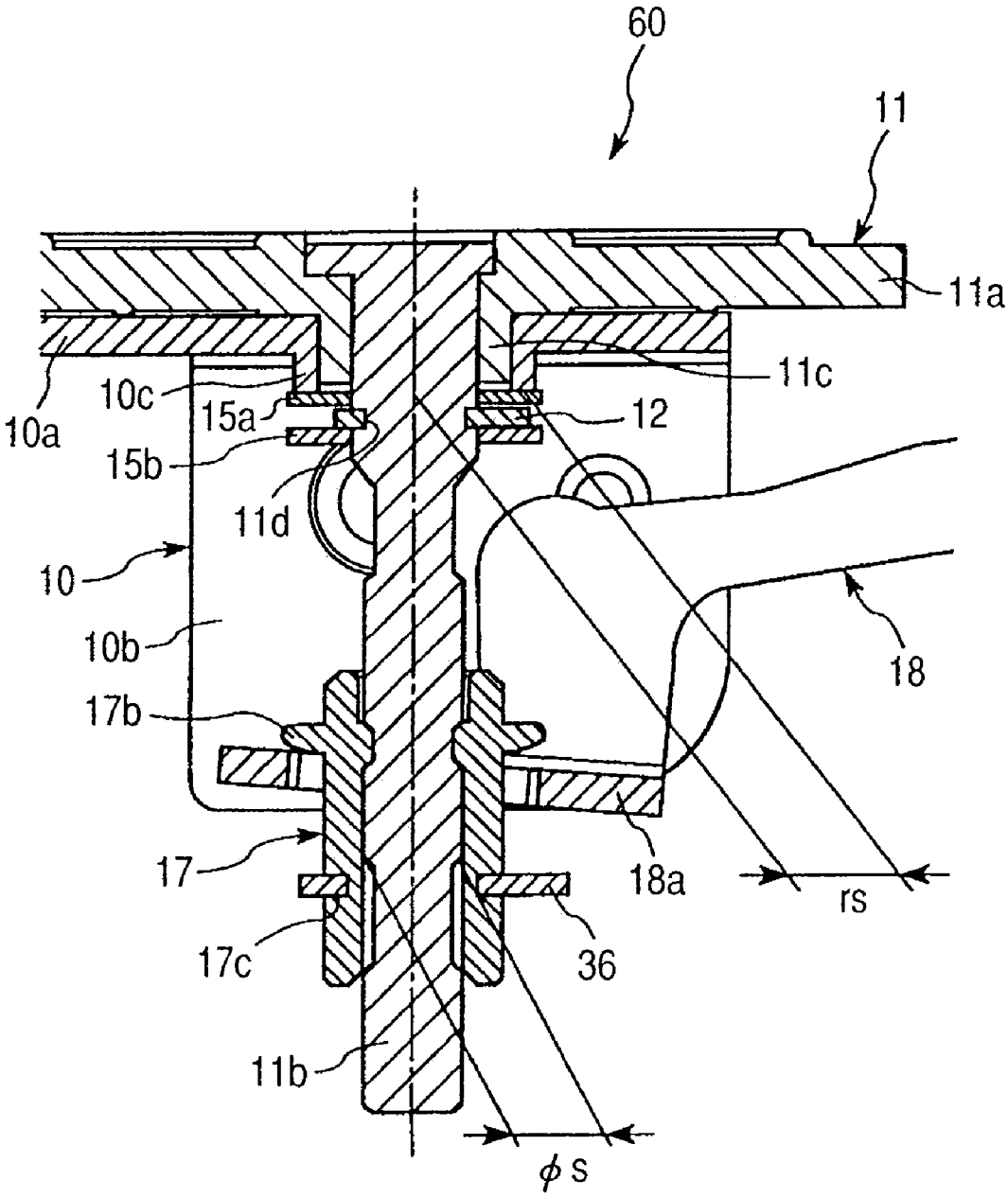
FIG. 11 is a cross-sectional view showing the belt training mechanism which the belt supporting device of FIG. 1 has.

In the present embodiment, the threaded gear 11 is installed to the main body 10*a* of the center adjusting unit chassis 10 such that it does not move in the longitudinal direction (vertical direction) of the threaded portion 11*b*, but becomes freely rotatable. As can be seen when referring to FIG. 11 showing the cross section of the neighborhood of an installation area of the threaded gear 11 in further detail, the threaded gear 11 is supported such that a sliding portion 11*c* for constituting a rotating shaft in the neighborhood of a coupled portion between the gear portion 11*a* and the threaded portion 11*b* can be rotated by a bearing portion 10*c* provided on the main body 10*a* of the center adjusting unit chassis 10. Also, in a groove portion 11*d* located in the neighborhood of this bearing portion 10*c* on the lower side and provided in the threaded portion 11*b* of the threaded gear, a fastening member 12 is fixed, whereby this fastening member 12 bumps against a washer 15*a* which has been inserted through the threaded portion 11*b* and arranged below the bearing portion 10*c* in such a manner that the threaded gear 11 does not move in the longitudinal direction of the threaded portion 11*b*.

The first, and second rollers 13*a*, 13*b* are, in the present embodiment, friction member rings at the outer periphery of which an elastic friction member has been provided. In this case, although as the elastic friction member, EPDM has been used, chloroprene rubber, urethane rubber, urethane foam and the like can be suitably used in addition. Also, in the present embodiment, below each of the first and second rollers 13*a*, 13*b*, first and second small gears 14*a*, 14*b* are fixed. The first and second rollers 13*a*, 13*b* are rotatively installed on the main body 10*a* of the center adjusting unit chassis 10 with a predetermined clearance to the rib 16 of the belt member 1 respectively, and in such a manner that the first and second small gears 14*a*, 14*b* engage with the gear portion 11*a* of the threaded gear 11.

The nut 17 is threadedly engaged with the threaded portion 11*b* of the threaded gear 11, and is held so as not to rotate in the direction of rotation of the threaded portion 11*b*. In the present embodiment, a rectangular sliding hole 18*b* provided in a drive receiving portion 18*a* of the lever 18 is caused to pass along a side surface 17*a* substantially uniformly flat to which the nut 17 opposes. Thereby, between a collar portion 17*b* of the nut 17 on the upper end side and a fastening member 36 to be installed to the groove portion 17*c* on the lower end side, the nut 17 is held by the drive receiving portion 18*a* so as not to rotate with some clearance in a direction indicated by an arrow Q1, Q2 in the figure.

Between the washer 15*b* which has penetrated the threaded portion 11*b* of the threaded gear 11 and has been arranged below the fastening member 12 and the collar portion 17*b* at the upper end of the nut 17, there is provided a biasing spring 35, which is an elastic member, as biasing means around the threaded portion 11*b* of the threaded gear 11. In a case where the nut 17 moves in a direction indicated by an arrow U/D in the figure and is deviated from the threaded portion 11*b* of the threaded gear 11, when the threaded portion 11*b* is reversed, the biasing spring 35 biases the nut 17 in a direction of the central position so as to threadedly engage with the threaded portion 11*b* again.

The lever 18 holds the nut 17 by the drive receiving portion 18*a* provided at one end portion in the longitudinal direction thereof as described above, and receives the movement of the nut 17 in a direction indicated by an arrow U/D in the figure to transmit this movement to the movable portion of the drive roller 2, that is, the bearing 6*a* on the first side plate 9*a* side. In the present embodiment, a shaft hole 18*d* is fitted in a rotary center axis 19 provided on the first side plate 9*a*, and the lever 18 is pivotally held by the first side plate 9*a* with the rotary center 19 axis as the center. Thus, an end portion 18*c* on the opposite side to the drive receiving portion 18*a* of the lever 18 is fixed to the bearing 6*a* of the drive roller 2 on the first side plate 9*a* side.

Also, in the present embodiment, the center adjusting unit 60 is provided with rib guide means 30 for guiding so as to hold the rib 16 within such a range as to be able to input a driving force to the first and second rollers 13*a*, 13*b*. The rib guide means 30 has a guide 31 and a guide lever 32 for sandwiching the rib 16 from the lower side and the upper side respectively to prevent the rib 16 from deviating in the up-and-down direction from between the first and second rollers 13*a*, 13*b*. The guide lever 32 is supported by the first side plate 9*a* so as to be able to rock in a direction indicated by an arrow S3 in the figure with the rocking center axis 32*c* as the center. The guide lever 32 is, at one end portion in the longitudinal direction, biased by a spring 32*d* which is an elastic member, as biasing means. Thus, the guide lever 32 sandwiches the rib 16 (and the belt member 11) between a sandwiching portion 32*a* provided in the neighborhood of the other end portion in the longitudinal direction and the guide 31. Also, the guide lever 32 has a stopper 32*b* at the end portion on the sandwiching portion 32*a* side, and in order to hold the clearance with the guide 31 so that the belt member 11 is not pushed excessively by the guide lever 32, the leading edge of this stopper 32*b* is caused to bump against the main body 10*a* of the center adjusting unit chassis 10.

Next, the description will be made of an operation of the center adjusting unit 60 further.

The belt member 1 is driven by the drive roller 2 to rotate in a direction indicated by an arrow Bf. At this time, no matter how accurately the precision and parallelism of the drive roller 2, the driven roller 3, the tension roller 4 and the belt member 1 may be controlled, the belt member 1 has a tendency to shift along either of the directions indicated by an arrow N/M as a lateral direction (shift direction).

Conventionally, the movement of the rib 16 has been regulated by a flange (not shown) provided as a regulating member, in such a manner that the movement of the belt member 1 in a direction substantially orthogonal to the conveying direction Bf of the belt member 1 is stopped. In this state, however, since a high frictional force is exerted between the rib 16 and the flange, the rib 16 is shaved, the frictional force with the flange become higher to run on to the flange, and it becomes impossible to maintain a position of the belt member 1 at a predetermined position, resulting in damage to the rib 16 and the belt member 1.

In contrast to this, in the belt supporting device 50 according to the present embodiment, since the center adjusting unit 60 having the above-described structure performs an automatic belt training operation of the belt member 1, the above-described problem does not occur.

Figure 10:
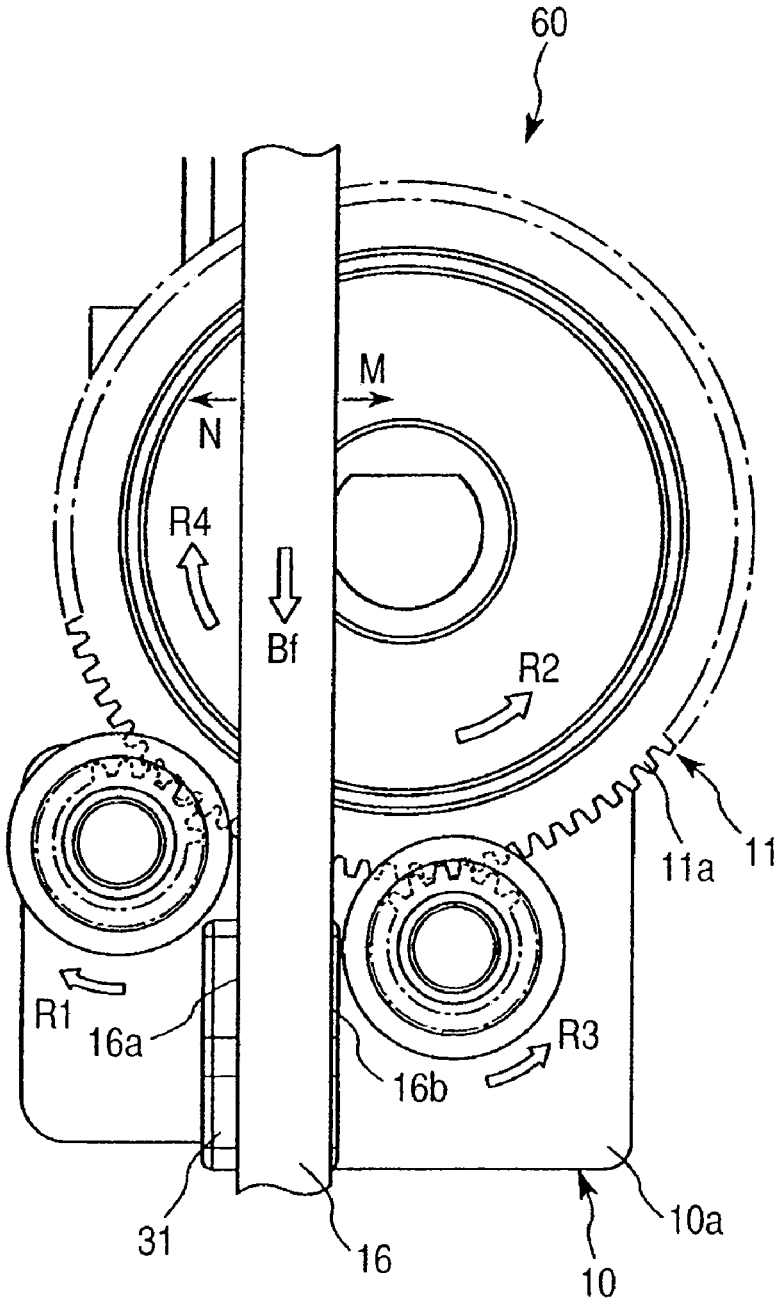
FIG. 10 is an enlarged view showing the belt training mechanism which the belt supporting device of FIG. 1 has.

In this case, in the belt supporting device 50 according to the present embodiment, with reference to FIGS. 7 and 10, the description will be made of a case where tentatively the belt member 1 inclines in a direction indicated by an arrow N in the figure. In this case, the first side surface (left-side side surface) 16*a* of the rib 16 comes into contact with the first roller 13*a*. Thus, the first roller 13*a* and the first small gear 14*a* coupled thereto integrally rotate in a direction indicated by an arrow R1 in the figure. As a result, the gear portion 11*a* of the threaded gear 11 engaged with the first small gear 14*a* rotates in a direction indicated by the same arrow R2, and at the same time, the threaded portion 11*b* of the threaded gear 11 rotates in the same direction. Thereby, the nut 17 impossible to rotate, threadedly engaged with the threaded portion 11*b* is caused to move in a direction indicated by an arrow D in the figure (downward). For this reason, the lever 18 is pushed by the collar portion 17*b* by the movement of the nut 17 to move the drive receiving portion 18*a* in the D direction for rotating in a direction indicated by an arrow X1 in the figure. Thereby, the lever 18 causes the bearing 6*a* of the drive roller 2 on the first side plate 9*a* side to move in a direction (upward) indicated by an arrow X2 in the figure.

Thus, when the bearing 6*a* of the drive roller 2 on the first side plate 9*a* side is caused to move in the X2 direction, an angle of the drive roller 2 to the driven roller 3 or the tension roller 4 changes. When alignment of the drive roller 2 inclines as described above, the belt member 1 reduces the tendency to shift along the lateral direction indicated by an arrow N in the figure, and starts to incline in a direction indicated by an arrow M in the figure. Therefore, the rib 16 separates from the first roller 13*a*.

When the belt member 1 shifts along a direction indicated by an arrow N in the figure by this operation at the beginning, the alignment of the drive roller 2 will be adjusted so as to negate the inclination tendency until the contact between the rib 16 and the first roller 13*a* becomes lost.

Similarly, when the belt member 1 shifts along in the direction indicated by the arrow M in the figure (opposite direction to the above) and the second side surface 16*b* of the rib 16 comes into contact with the second roller 13*b*, the second roller 13*b* and the second small gear 14*b* integrally coupled thereto rotate in the direction indicated by the arrow R3 in the figure. Therefore, the gear portion 11*a* of the threaded gear 11 and the threaded portion 11*b* rotate in the direction indicated by the arrow R4 in the figure. Thereby, the nut 17 is caused to move in the direction (upward) indicated by the arrow U in the figure, the lever 18 rotates in the direction indicated by the arrow X3 in the figure, and the bearing 6*a* of the drive roller 2 on the first side plate 9*a* side is caused to move in the direction (downward) indicated by the arrow X4 in the figure.

Thereby, the alignment of the drive roller 2 inclines in an opposite direction to the above-described one.

Figure 8:
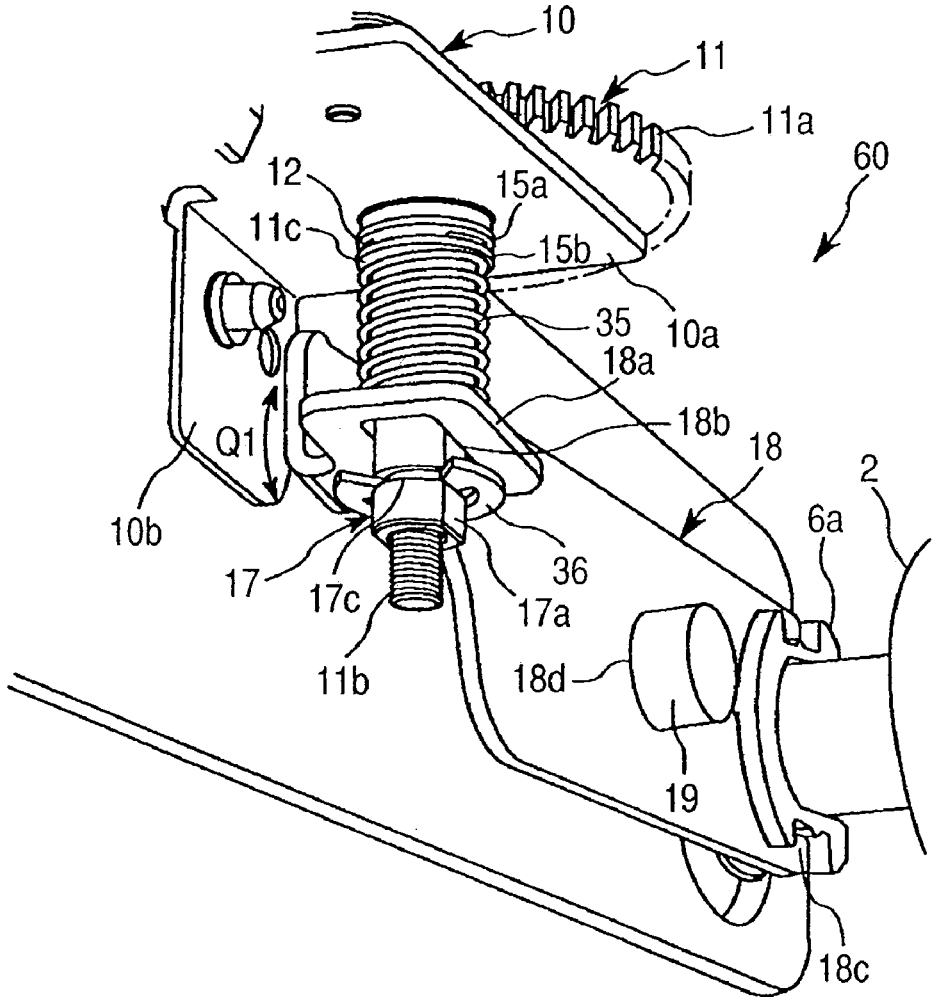
FIG. 8 is an enlarged view showing the belt training mechanism which the belt supporting device of FIG. 1 has.
Figure 9:
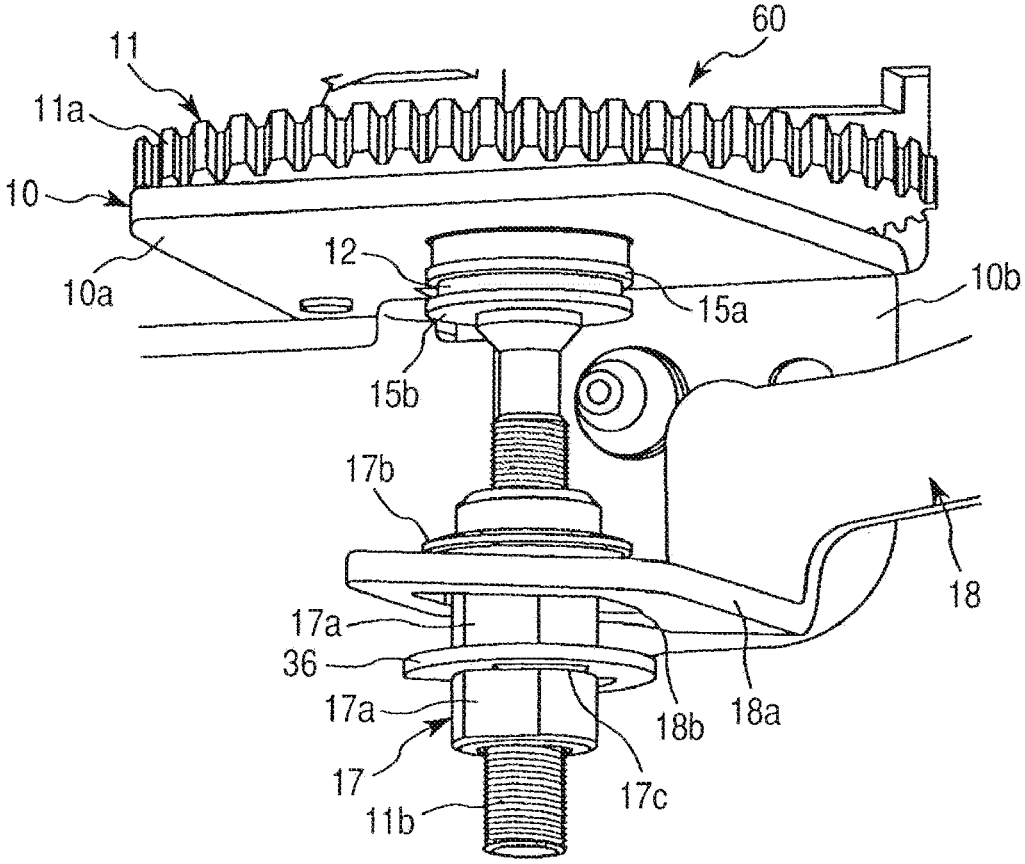
FIG. 9 is an enlarged view showing the belt training mechanism which the belt supporting device of FIG. 1 has.

The above-described operation controls the rib 16 so as to be always located between the first and second rollers 13*a*, 13*b*, and the belt member 1 is also held in such a position as to cause the rib 16 to exist within that range. Since the first and second rollers 13*a*, 13*b* for operating for belt training of the belt member 1 are arranged on both sides of the rib 16, a force for correcting an inclination to both directions can be obtained at a single end of the belt member 1. Also, when the rib 16 comes into contact with the first and second rollers 13*a*, 13*b*, a force of movement of the belt member 1 in the direction of rotation changes the alignment of the drive roller 2 and therefore, there occurs also an effect that continuation of the rib 16 striking against the first and second rollers 13*a*, 13*b* with a strong force becomes lost. Since speed of rotary movement of the belt member 1 is significantly faster than speed of inclination of the belt member 1, correction of the inclination of the belt member 1 is completed in an exceedingly short period of time. For this reason, it is possible to prevent the flatness of the belt member 1 from being deteriorated by the rib 16 being shaved or a strong force being applied to the rib 16 in advance. Further, since the rib 16 comes into contact with the first, and second rollers 13*a*, 13*b*, the flatness of the belt member 1 is exceedingly less affected. In this respect, FIGS. 8 and 9 show an enlarged view obtained by observing surroundings of the threaded gear 11 from another angle.

Next, the description will be made of setting in which when an external force is exerted on the drive roller 2 by, for example the external force (frictional force) being applied to the belt member 1 itself, the threaded gear 11 is caused not to be rotated by the external force, that is, the force is caused not to be transmitted to the drive receiving means from the supporting member. This structure is adopted because when a force is exerted on the supporting member, it is desired to prevent rotary movement of the belt member 1 from being hindered. When the rotary movement of the belt member 1 is hindered, a strong force is generated between the first and second rollers 13*a*, 13*b* and the rib member to possibly shave the rib or not to maintain the flatness of the belt member 1. Also, in a case where a force of movement is inputted from the first and second rollers 13*a*, 13*b*, when its reaction strongly works, stable belt training may not be performed. Thus, the center adjusting unit 60 is constructed as described below. In other words, in this case, the following parameter groups will be set as described below.

(a) A mutual coefficient of friction between the threaded portion 11*b* of the threaded gear 11 and the nut 17 is set to μsn.

(b) A coefficient of friction with the bearing for regulating the movement of the threaded gear 11 and the threaded portion 11*b* of the threaded gear 11 in the longitudinal direction is set to μsb.

(c) The outer diameter (See FIG. 11) of the threaded portion 11*b* is set to Φs.

(d) A distance between the bearing of the threaded gear 11 and the center of the threaded portion 11*b* of a sliding portion is set to rs.

(e) A pitch of the threaded portion 11*b* is set to Ps.

(f) A thrust due to an external force to be applied to the nut 17 is set to F.

At this time, moment which is going to rotate the threaded portion 11*b* is expressed by the following formula (1).

$$F \cdot Ps/(\phi s \cdot \pi) \cdot \phi s/2 \quad (1)$$

On the other hand, friction moment caused by the thrust F is expressed by the following formula (2).

$$F \cdot \cos\theta^2 \cdot \mu sn \cdot \phi s/2 + F\ \mu sb \cdot rs \quad (2)$$

Therefore, by satisfying the following formula (3), $$\text{Formula (2)} > \text{Formula (3)} \quad (3)$$

when an external force is exerted on the drive roller 2, it is possible to cause the threaded gear 11 not to be rotates by the external force.

where $$\cos\theta = (\phi s \cdot \pi)^2/((\phi s \cdot \pi)^2 + Ps^2)$$

More specifically, so as to satisfy the above-described formula (3), material of the threaded portion of the threaded gear 11, material of the nut 17, material of a bearing for regulating movement of the threaded gear 11 and the threaded portion 11*b* of the threaded gear 11 in the longitudinal direction, an outer diameter Φs of the threaded portion 11*b*, distance between the bearing of the threaded gear 11 and the center of the threaded portion 11*b* of a sliding portion rs, pitch Ps of the threaded portion 11*b* and the like can be appropriately set. As one specific embodiment, in this case, as the material of the threaded portion of the threaded gear 11, nickel-plated iron is selected; as the material of the nut 17, POM; as the material of the bearing for regulating the movement of the threaded gear 11 and the threaded portion 11*b* of the threaded gear 11 in the longitudinal direction, POM; the outer diameter of the threaded portion 11*b* is set to Φs=3 mm; the distance (See FIG. 11) between the bearing of the threaded gear 11 and the center of the threaded portion 11*b* of a sliding portion, rs=2.5 mm; the pitch of the threaded portion 11*b*, Ps=0.5 mm, and the like, whereby the following has been set.

μsn: 0.3
μsb: 0.3
Φs: 3 mm
rs: 2.5 mm
Ps: 0.5 mm

Thereby, the above-described expression (3) is satisfied (since F is a coefficient relating to both sides in the expression 3, the expression 3 holds irrespective of the value of F.).

In this respect, in the present embodiment, the description has been made of the belt supporting device 50 as one using three rollers, but in the present invention, at least two rollers will suffice, and the belt training operation of the belt member 1 is performed iffespective of a number of the rollers.

Also, a pitch of the threaded portion 11*b* of the threaded gear 11 needs not be constant, but in accordance with a response of inclination speed of the belt member 1, the pitch of the threaded portion 11*b* is made coarse, for embodiment, at the central part of the threaded portion 11*b* in the longitudinal direction, and fine on both end portion sides, that is, in the neighborhood of the side end portion of the coupled portion with the gear portion 11*a* and the leading edge, whereby a transfer function of the response is adjusted and time required to converge the belt training can be shortened. In this case, the thread on the nut 17 side is made into one turn or less.

As described above, according to the structure of the present embodiment, the precision/parallelism of the roller, which is the belt supporting member, and the precision of the belt member 1 and/or the rib 16 need not be strictly controlled, but distortion of the equipment during installation and the inclination tendency due to endurance use are automatically coffected in real time, whereby it is possible to hold the belt member 1 and/or the rib 16 at the predetermined position without applying a continuous stress on them, and to avoid any damage due to the belt member 1 and/or the rib running on the regulating member.

As described above, according to the present embodiment, (1) Since the belt member 1 can be rotated in a state in which it has been held at the predetermined position for a long time even if it has no contraction and expansion properties but is of material easy to be broken, a selection range of the material of the belt member 1 is extended, and it becomes possible to select material optimum for the use. Particularly, when the belt member 1 is used as the intermediate transfer member or the like, a thin belt having low contraction and expansion properties is suitable and is very effective because the electrostatic characteristic and property for holding an image without distorting are needed.

(2) Also, since this is a mechanism for automatically belt-training the belt member 1 such that the belt comes to a proper position in response to the state of use, dimensions and shape of the belt member 1 or the roller, or parallelism of the roller need not any strict precision. Further, the installation of the belt supporting device 50 need no strict precision. For this reason, a low-priced, high-durability belt supporting device 50 having a belt member 1 with excellent positional precision can be implemented.

(3) Also, according to the structure of the present embodiment, since the position of the roller does not change even when an external force is applied to the roller, before and after the belt supporting device 50 is transported, the position of the roller does not change, but even after the transportation, the belt member 1 does not show a great inclination tendency, but stable travel can be realized.

(4) Also, when the belt member 1 is used as the intermediate transfer member, an external force (frictional force) is applied to the belt member 1 itself, and the external force becomes an external force to the roller. With the structure of the present embodiment, an external force to be applied to the second supporting member (driven roller 2) capable of changing an angle to the first supporting member (driven roller 3 or tension roller 4) is transmitted to the gear portion 11*a* of the threaded gear 11, which is a rotation member, and even in this structure in which this external force is transmitted to the first and second rollers 13*a*, 13*b* having the first and second small gears 14*a*, 14*b*, there does not arise such a problem as to cause a strange sound or to lead to abnormal abrasion by hindering traveling of the belt member 1, or by the rib and/or the belt member 1 strongly slidably contacting the first and second rollers 13*a*, 13*b* and the like.

(5) Also, generally in order to make the belt supporting device 50 interchangeable, it is required that structure be arranged such that it can be removed from the main body A of the image forming apparatus. Since according to the present invention, the belt supporting device 50 automatically performs belt-training of the belt member 1 irrespective of the state of installation, a change in the state of installation at the time of attachment/detachment of the unit will not affect the service life of the belt member 1, but it can be used with stability. Such an effect can be exhibited.

Second Embodiment

Next, the description will be made of another embodiment of the present invention. In the present embodiment, since the basic structure of the image forming apparatus, to which the present invention is applied, and the belt supporting device which the image forming apparatus has, is the same as in the first embodiment, elements having functions and structure identical to or corresponding to those in the first embodiment are designated by the identical reference numerals, and detailed description is omitted.

Figure 12:
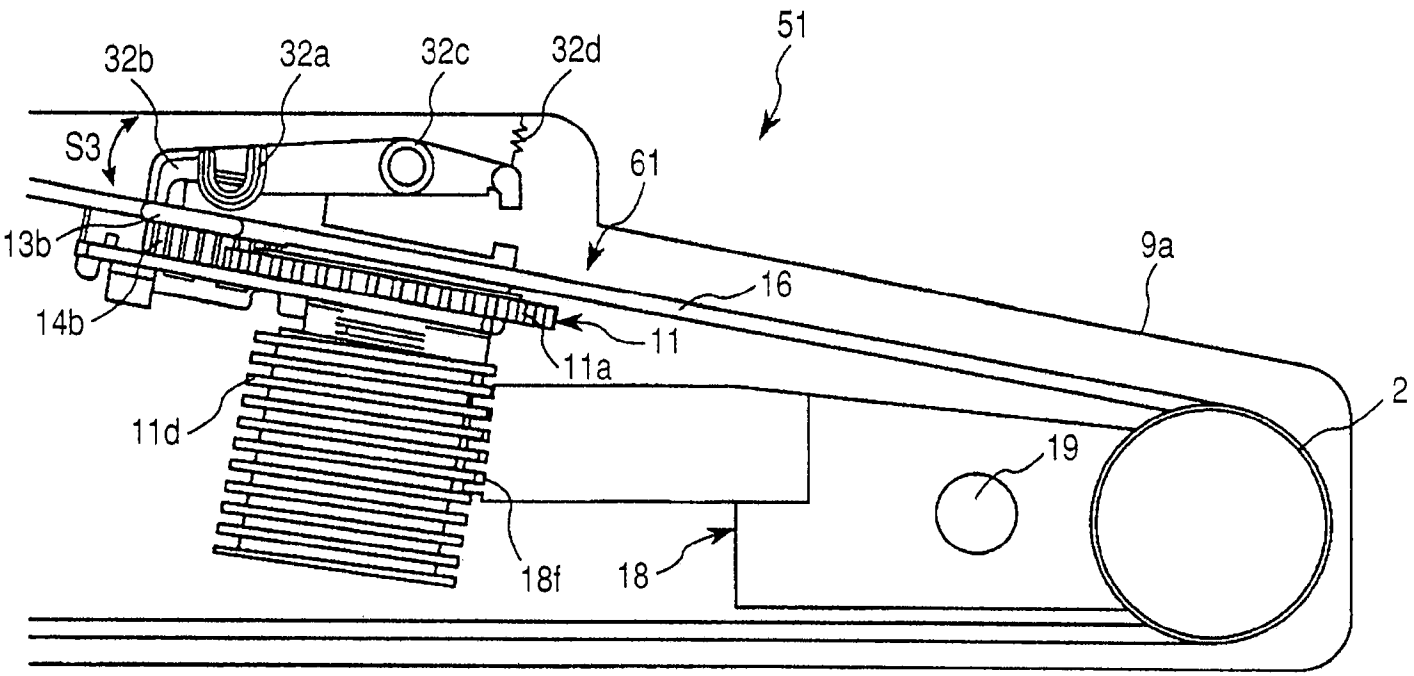
FIG. 12 is a side view showing the belt training mechanism according to another embodiment of the present invention.

FIG. 12 is a side view in which the first side plate 9*a* of the belt supporting device 50 has been seen from the inside, showing the feature of the center adjusting unit 61 of the belt supporting device 51 according to the present embodiment exceedingly well.

In the first embodiment, the drive receiving portion 18*a* of the lever 18 and the nut 17 have been engaged with each other with a clearance (direction indicated by an arrow Q1, Q2 in the figure). In other words, in the first embodiment, the moving element (nut 17) which is driven, for moving, by driving means (threaded portion 11*b* of the threaded gear 11) which is rotated by turning effect of the first and second rollers 13*a*, 13*b*, which are contact members, has been handled as a separate member from the drive receiving portion 18*a* of the lever 18.

In contrast, in the present embodiment, these driving means and moving means are made integral. By means of a worm gear consisting of a worm (spiral boss) 11*d* which rotates integrally with the gear portion 11*a* of the threaded gear 11 as a rotation member, and a partial worm wheel 18*f* provided at the leading edge of the lever 18, which is a coupling element, the lever 18 is driven. As described above, in the present embodiment, the worm wheel 18*f*, which is the moving element, and the drive receiving portion of the lever 18 are made integral.

According to the structure of the present embodiment, the similar effect to the first embodiment can be exhibited, the number of parts is reduced, and the clearance is reduced, and therefore, the responsivity of the belt training operation is improved.

Third Embodiment

Next, the description will be made of still another embodiment according to the present invention.

In each of the above-described embodiments, the description has been made of the belt member 1 as the intermediate transferring member (intermediate transferring belt), but the present invention is not limited thereto.

As well known to those skilled in the art, there has conventionally been an image forming apparatus of a type in which toner images formed on one or more image bearing members are transferred onto transferring material which is borne on a transferring material bearing member rotary-movable in opposition to the image bearing members to be conveyed, thereafter the transferring material, on which the toner images have been transferred, is separated from the transferring material bearing member, and the toner images are fixed on the transferring material for obtaining the recording image.

Figure 14:
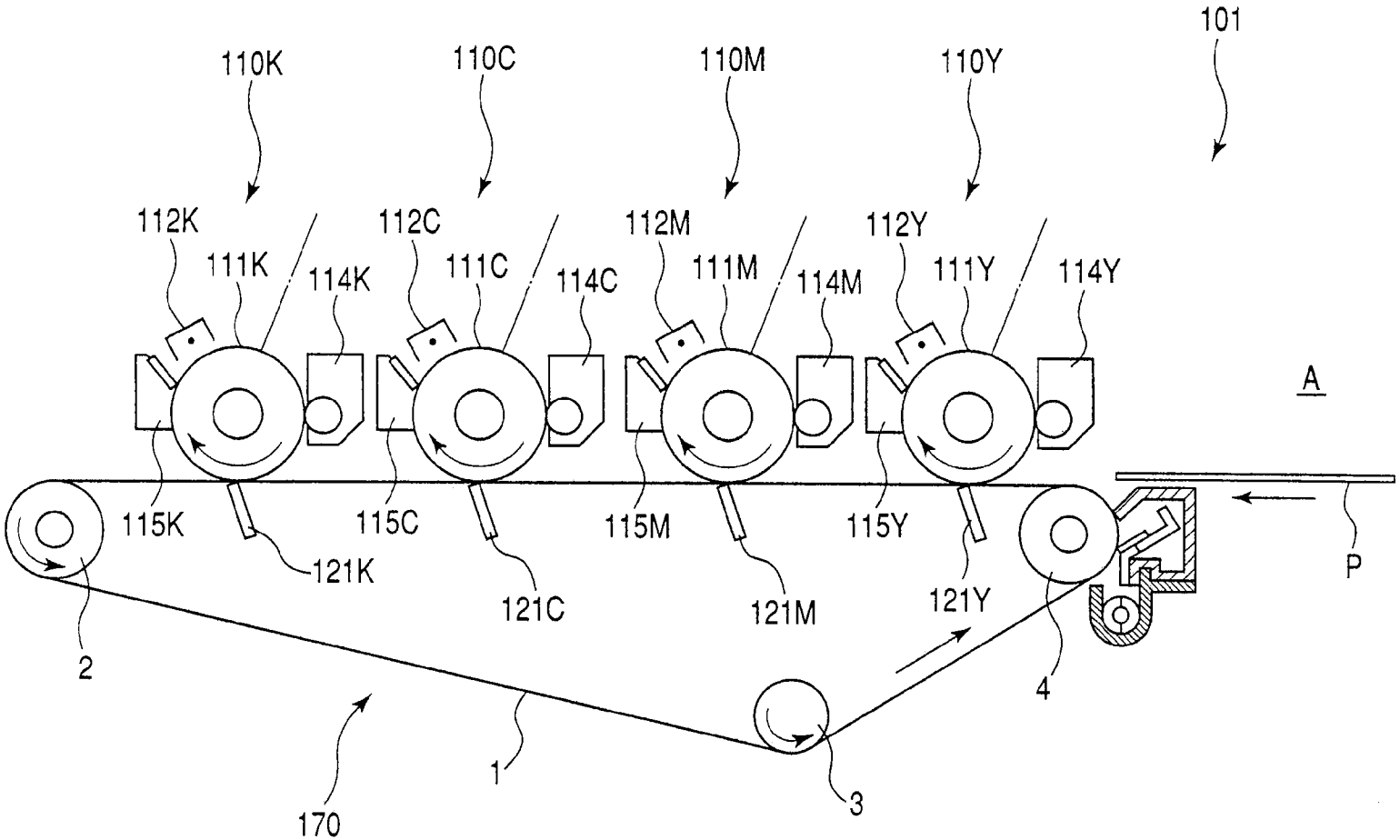
FIG. 14 is a schematic cross-sectional block diagram showing another embodiment of the present invention.

FIG. 14 shows schematic cross-sectional structure of one embodiment of the image forming apparatus of such a type. In the embodiment shown, the image forming apparatus 101 has each image forming unit 110Y, 110M, 110C and 110K for forming toner images of each color of yellow, magenta, cyan and black respectively as a plurality of image forming means. Since in each image forming unit, a process of forming toner images on photosensitive drums 111Y, 111M, 111C and 111K, which are image bearing members is similar to one explained in the first embodiment, elements having functions and structure identical to or corresponding to the image forming apparatus 100 of the first embodiment are designated by the identical reference numerals, and detailed description is omitted.

In synchronization with the formation of toner images on the photosensitive drums 111Y, 111M, 111C and 111K in each image forming unit 110Y, 110M, 110C and 110K, transferring material P is sent out from a transferring material supply unit (not shown) to be supplied onto the belt member 1, which is the transferring material bearing member. Thus, toner images of each color formed on each photosensitive drum 111Y, 111M, 111C and 111K are transferred in order on the transferring material P to be conveyed on the belt member 1 by the operation of transferring means 115Y, 115M, 115C and 115K arranged in opposition to each photosensitive drums 111Y, 111M, 111C and 111K via the belt member 1. When this transferring process is completed, the transferring material P is separated from the belt member 1 to be conveyed to a fixing device which is fixing means (not shown), where an unfixed toner image is fixed and thereafter, is discharged outside the image forming apparatus.

The present invention can be also suitably applied to an image forming apparatus equipped with the belt member 1 which is used as such a transferring material bearing member. In other words, in the image forming apparatus 101 shown in FIG. 14, the transferring material conveying unit 170 (may be either detachably attachable to the main body A of the image forming apparatus or fixed) is caused to have the same structure as the belt supporting device 50 or 51 having the center adjusting unit 60 explained in each of the above-described embodiments, whereby the operation effect similar to each of the above-described embodiments can be exhibited.

In these above-described embodiments, the printer has been illustrated as the image forming apparatus, but the present invention is not limited thereto, and other image forming apparatuses such as, for example, copying machines and facsimile machines or other image forming apparatuses such as compound machines obtained by combining these functions, may be used, and similar effects can be obtained by applying the present invention to the image forming apparatuses.

Further, the description has been made of the present invention by showing various embodiments, and the gist and the scope of the present invention are not limited to specific description and figures of the present specification. For embodiment, the belt member may be supported using four or more supporting rollers.

Further, the description has been made of the present invention by showing various embodiments, and the gist and the scope of the present invention are not limited to specific description and figures of the present specification. For embodiment, the belt member may be tensioned using four or more tensioning rollers.

This application claims priority from Japanese Patent Application No. 2003-329180 filed Sep. 19, 2003, which is hereby incorporated by reference herein.

What is claimed is:

1. An image forming apparatus comprising:

a belt member that bears a toner image or a transferring material, said belt member effecting a circular movement;

a supporting member for supporting said belt member;

a tension member for giving tension to said belt member;

first and second drive receiving members, each of which is capable of receiving a force by the circular movement of said belt member; and a drive converting member for mechanically converting the force input to each of said first and second drive receiving members into a force to change an angle of said supporting member, wherein the force that arises from the circular movement is transmitted by bringing said belt member into contact with said drive receiving members, and wherein a variation of the angle of said supporting member depends on a manner in which either of said first drive receiving member or said second drive receiving member receives the force by the circular movement.

2. An image forming apparatus according to claim 1, wherein said supporting member has a roller shape, and the angle of said supporting member is an angle of a center axis of said supporting member.

3. An image forming apparatus according to claim 1, wherein said belt member has a rib member, and said first and second drive receiving members receive the force by bringing the rib member into contact with said first and second drive receiving members.

* * * * *

UNITED STATES PATENT AND TRADEMARK OFFICE

CERTIFICATE OF CORRECTION

PATENT NO. : 7,389,068 B2
APPLICATION NO. : 11/756982
DATED : June 17, 2008
INVENTOR(S) : Yoshihiro Ito It is certified that error appears in the above-identified patent and that said Letters Patent is hereby corrected as shown below:

ON THE COVER PAGE:

In item "(57) ABSTRACT," line 9, "convex" should read -- the convex --.

COLUMN 1:

Line 66, "member to" should read -- member, contributing to --.

COLUMN 2:

Line 12, "above-describe" should read -- above-described --.

COLUMN 3:

Line 34, "feffing" should read -- ferring --.
Line 48, "1110M" should read -- 110M --.

COLUMN 4:

Line 53, "convened" should read -- converted --.

COLUMN 6:

Line 30, "transfeffing" should read -- transferring --.

COLUMN 8:

Line 44, "flat to" should read -- flat, which --.

COLUMN 9:

Line 48, "become" should read -- becomes --.

COLUMN 11:

Line 50, "rotates" should read -- rotated --.
Line 51, "force." should read -- force, --.

COLUMN 12:

Line 27, "embodiment," should read -- example, --.
Line 65, "any" should read -- have any --.
Line 66, "need" should read -- needs --.

COLUMN 14:

Line 58, "drums" should read -- drum --.

UNITED STATES PATENT AND TRADEMARK OFFICE

CERTIFICATE OF CORRECTION

PATENT NO. : 7,389,068 B2
APPLICATION NO. : 11/756982
DATED : June 17, 2008
INVENTOR(S) : Yoshihiro Ito It is certified that error appears in the above-identified patent and that said Letters Patent is hereby corrected as shown below:

COLUMN 15:

Line 24, "embodiment," should read -- example, --.
Lines 25-31 should be deleted.

Signed and Sealed this

Eleventh Day of November, 2008

JON W. DUDAS
*Director of the United States Patent and Trademark Office*